US010414184B2

(12) United States Patent
Hanyu et al.

(10) Patent No.: US 10,414,184 B2
(45) Date of Patent: Sep. 17, 2019

(54) PRINT METHOD USING PRINTER MODULE OF PORTABLE LABEL PRINTING/STICKING MACHINE AND PRINTER MODULE

(71) Applicant: SATO HOLDINGS KABUSHIKI KAISHA, Tokyo (JP)

(72) Inventors: Mitsutaka Hanyu, Kanagawa (JP); Kentaro Tabuchi, Tokyo (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 66 days.

(21) Appl. No.: 15/510,413

(22) PCT Filed: Jan. 22, 2016

(86) PCT No.: PCT/JP2016/051851
§ 371 (c)(1),
(2) Date: Mar. 10, 2017

(87) PCT Pub. No.: WO2016/121647
PCT Pub. Date: Aug. 4, 2016

(65) Prior Publication Data

US 2017/0282624 A1 Oct. 5, 2017

(30) Foreign Application Priority Data

Jan. 30, 2015 (JP) ..... 2015-016809

(51) Int. Cl.
*B41K 1/10* (2006.01)
*B41K 3/58* (2006.01)
(Continued)

(52) U.S. Cl.
CPC ..... *B41K 1/10* (2013.01); *B41K 3/58* (2013.01); *B41K 5/023* (2013.01); *B65C 9/46* (2013.01); *B65C 11/0215* (2013.01)

(58) Field of Classification Search
CPC ... B41K 1/10; B41K 3/00; B41K 3/58; B41K 5/023; B65C 9/46; B65C 11/02; B65C 11/0215
See application file for complete search history.

(56) References Cited

U.S. PATENT DOCUMENTS 1,362,329 A * 12/1920 Lang ..... B41K 1/10 101/111
4,057,452 A * 11/1977 Sato ..... B65C 9/18 101/288

(Continued)

FOREIGN PATENT DOCUMENTS

JP 2011-152800 A 8/2011

*Primary Examiner* — Matthew G Marini
*Assistant Examiner* — Marissa Ferguson-Samreth
(74) *Attorney, Agent, or Firm* — Foley & Lardner LLP

(57) ABSTRACT

A print method using a printer module of a portable label printing/sticking machine, the portable label printing/sticking machine performing printing on each label piece of a continuous label formed by temporarily adhering a plurality of label pieces on a ribbon-shaped liner sheet and sticking the label pieces, wherein the printer module is first and second printer modules provided in at least two vertical stages, any one of the first and second printer modules being provided with an item print band across at least two columns, the other one of the first and second printer modules being provided with a data print band, and the print method includes printing a partitioning frame that partitions a print area of the label piece into four regions including upper left, upper right, lower left, and lower right regions on the label piece in advance; and printing on the four regions of the print area using the first and second printer modules.

6 Claims, 7 Drawing Sheets

(51) Int. Cl.

| | |
|---|---|
| ***B65C 9/46*** | (2006.01) |
| ***B65C 11/02*** | (2006.01) |
| ***B41K 5/02*** | (2006.01) |

(56) References Cited

U.S. PATENT DOCUMENTS

| | | | | |
|---|---|---|---|---|
| 4,075,944 | A * | 2/1978 | Conley | B41K 3/06 101/288 |
| 4,113,544 | A * | 9/1978 | Sato | B65C 11/0247 101/288 |
| 2002/0170447 | A1 * | 11/2002 | Heckmann | B41K 1/10 101/111 |
| 2007/0298202 | A1 | 12/2007 | Jacobs et al. | |

* cited by examiner

PRINT METHOD USING PRINTER MODULE OF PORTABLE LABEL PRINTING/STICKING MACHINE AND PRINTER MODULE

TECHNICAL FIELD

The present invention relates to a print method using a printer module of a portable label printing/sticking machine and a printer module, capable of printing items or data across at least two vertical stages.

BACKGROUND ART

In the prior art, there is known a portable label printing/sticking machine, in particular, for use in food products or food materials. In this portable label printing/sticking machine, items such as a production date, an expiration date, a freshness date, and various items regarding freezing, thawing, heating, and other various treatment cautions and data such as dating for management or a specific date/time are printed on a label. If printer modules are individually provided for every item print or every data print, the number of the printer modules and the size of the printer modules increase disadvantageously. Therefore, it is necessary to provide a printer module equipped in the portable label printing/sticking machine within a limited range of the weight and the size. In particular, it is desirable to print each data regarding at least two types of independent items on a single label. For example, in order to print two types of items and corresponding data, generally, the printer module is required to have a total of four stages aligned in a vertical direction. This is not practical in actual use of the portable label printing/sticking machine.

For example, FIGS. 6A and 6B illustrate a typical example of two-stage print on a label piece 1. FIG. 6A is a top plan view illustrating the label piece 1, and FIG. 6B is an exploded view illustrating index letters and/or symbols of a data print band 2 for printing, for example, a horizontal four-digit code on the label piece 1. As illustrated in FIG. 6A, printing is performed on the label piece 1 using a vertical two-stage printer module (not shown) to indicate, for example, an expiration date from "December 1 (1201)" printed on an upper print section 3 to "December 2 (1202)" printed on a lower print section 4.

As illustrated in FIG. 6B, each data print band 2 is configured to print letters and/or numbers such as "1, 2, . . . , 9, 0" and "AM" or "PM" and other necessary symbols. However, the data print band 2 is configured to display, for example, thirteen letters or numbers due to constraints in the size or the weight of the portable label printing/sticking machine equipped with the printer module.

However, in the display printed on the label piece 1 of FIGS. 6A and 6B, naturally, it is necessary to separately print the "expiration date" or previously understand that such a print indicates the expiration date.

FIGS. 7A and 7B illustrate an example of a label piece 5 in which the "expiration date" can be seen clearly. FIG. 7A is a top plan view illustrating the label piece 5, and FIG. 7B is an exploded view illustrating index letters and/or symbols of an item print band 6 for printing an item such as the "expiration date" on the label piece 5. Note that the item print band 6 is wider than the data print band 2 to display items. In addition, similar to the data print band 2, for example, thirteen letters and/or symbols can be printed.

As illustrated in FIG. 7A, the label piece 5 has an upper print section 7, a middle print section 8, and a lower print section 9. Using a printer module (not shown) having three vertical stages, the "expiration date" is displayed on the middle print section 8 using the item print band 6, and "1201 (December 1)" printed on the upper print section 7 and "1202 (December 2)" printed on the lower print section 9 are displayed using the data print band 2 (FIG. 6B).

In particular, in a food product labeling system, the types of item prints such as a "freshness date" or "production calendar date" tend to increase in addition to the "expiration date." Therefore, it is desirable to print each data, for example, for at least two types of independent items on the single label piece 1 or 5 depending on the number of item prints as described above.

CITATION LIST

Patent Documents

Patent Document 1: JP2011-152800A

SUMMARY OF INVENTION

Problem to be Solved by Invention

In view of the aforementioned problems, it is therefore an object of the present invention to provide a print method using a printer module of a portable label printing/sticking machine and a printer module, by which an item and corresponding data can be printed across at least two vertical stages.

The present invention provides a print method using a printer module of a portable label printing/sticking machine and a printer module, by which at least two types of independent data such as dating and items thereof can be printed within a restricted number of stages.

The present invention provides a print method using a printer module of a portable label printing/sticking machine and a printer module, by which necessary information can be printed on a label piece having a size restriction.

Solution to Problem

The present invention focuses on an item print band provided in any one of the first and second printer modules provided in at least two vertical stages as a printer module. According to a first aspect of the invention, there is provided a print method using a printer module of a portable label printing/sticking machine, the portable label printing/sticking machine performing printing on each label piece of a continuous label formed by temporarily adhering a plurality of label pieces on a ribbon-shaped liner sheet and sticking the label pieces, wherein the printer module is first and second printer modules provided in at least two vertical stages, any one of the first and second printer modules being provided with an item print band across at least two columns, the other one of the first and second printer modules being provided with a data print band, and the print method includes printing a partitioning frame that partitions a print area of the label piece into four regions including upper left, upper right, lower left, and lower right regions on the label piece in advance, and printing on the four regions of the print area using the first and second printer modules.

In the print method described above, an item may be printed in left and right regions of any one of upper and lower print sections of the four partitioned regions partitioned into four regions including the upper left, upper right, lower left, and lower right regions of the label piece using the item print band, and data corresponding to the item may be printed in left and right regions of the other one of the upper and lower print sections of the four regions using the data print band.

In the print method described above, display data regarding at least any one of the item and the data to be printed may be printed in the partitioning frame in advance.

According to a second aspect of the present invention, there is provided a printer module of a portable label printing/sticking machine that performs printing on each label piece of a continuous label formed by temporarily adhering a plurality of label pieces on a ribbon-shaped liner sheet and sticking the label pieces, wherein the printer module is first, second, and third printer modules provided in three vertical stages, the second printer module located in a center of the first to third printer modules being provided with an item print band to print at least two types of items, and data corresponding to the items are printed using the first and third printer modules located above and below the second printer module.

In the printer module of the portable label printing/sticking machine described above, the item print band may be configured to print a partitioning frame for partitioning the items into two vertical regions on the label piece along with the items.

Advantageous Effect of the Invention

In the print method using the printer module of the portable label printing/sticking machine and the printer module according to the present invention, the item print band is provided in any one of first and second printer modules provided in at least two vertical stages as a printer module, and two types of items can be printed using the item print band. Therefore, it is possible to perform printing on a label piece 1 depending on item print or data print necessitating various prints.

In particular, according to the first aspect of the present invention, a partitioning frame that partitions a print area of the label piece into four regions, including upper left, upper right, lower left, and lower right regions, is printed on the label piece in advance, and printing is performed on the four regions of the print area using the first and second printer modules. Therefore, it is possible to individually performing the item print and the data print for each region. In addition, since the item print band is provided in at least two columns, it is possible to cope with an increase of the item print.

In particular, according to the second aspect of the present invention, first, second, and third printer modules are provided as a printer module in three vertical stages, and an item print band is provided in the second printer module located in a center of the first to third printer modules to print at least two types of items. In addition, data corresponding to the items are printed using the first and third printer modules located above and below the second printer modules. As a result, it is possible to display the items accordingly even when information regarding the item print increases.

BRIEF DESCRIPTION OF DRAWINGS

FIGS. 4A to 4C are diagrams for explaining a print method in two vertical stages on a label piece 23 (first embodiment), in which FIG. 4A is a top plan view illustrating the label piece 23 before printing on two vertical stages, and FIG. 4B is an exploded view illustrating index letters and/or symbols for two columns of an item print band 6 and four columns of a data print band 2 to perform printing, and FIG. 4C is a top plan view illustrating the label piece 23 obtained by performing printing in two vertical stages;

FIGS. 5A to 5C are diagrams for explaining a case where printing is performed in three vertical stages on the label piece 23 according to a second embodiment of the invention, in which FIG. 5A is a top plan view illustrating the label piece 23 before printing is performed in three vertical stages, FIG. 5B is an exploded view illustrating index letters and/or symbols of an item print band 50 to perform printing, and FIG. 5C is a top plan view illustrating the label piece 23 obtained by performing printing in three vertical stages;

FIGS. 6A and 6B are diagrams for explaining a typical example of two-stage printing on a label piece 1 in the prior art, in which FIG. 6A is a top plan view illustrating the label piece 1, and FIG. 6B is an exploded view illustrating the index letters and/or symbols of the data print band 2, for example, for printing four horizontal digits on the label piece 1; and FIGS. 7A and 7B are diagrams for explaining an example of the label piece 5 on which the "expiration date" is clearly seen, in which FIG. 7A is a top plan view illustrating the label piece 5, and FIG. 7B is an exploded view illustrating the index letters and/or symbols of the item print band 6 for printing items such as the "expiration date" on the label piece 5.

DESCRIPTION OF EMBODIMENTS

According to the present invention, a print method using a printer module of a portable label printing/sticking machine and a printer module, capable of printing on a label piece depending on an item print or a data print necessitating various prints, are implemented by providing an item print band capable of printing two types of items in any one of first and second printer modules provided in at least two vertical stages as a printer module.

Embodiments

Figure 1:
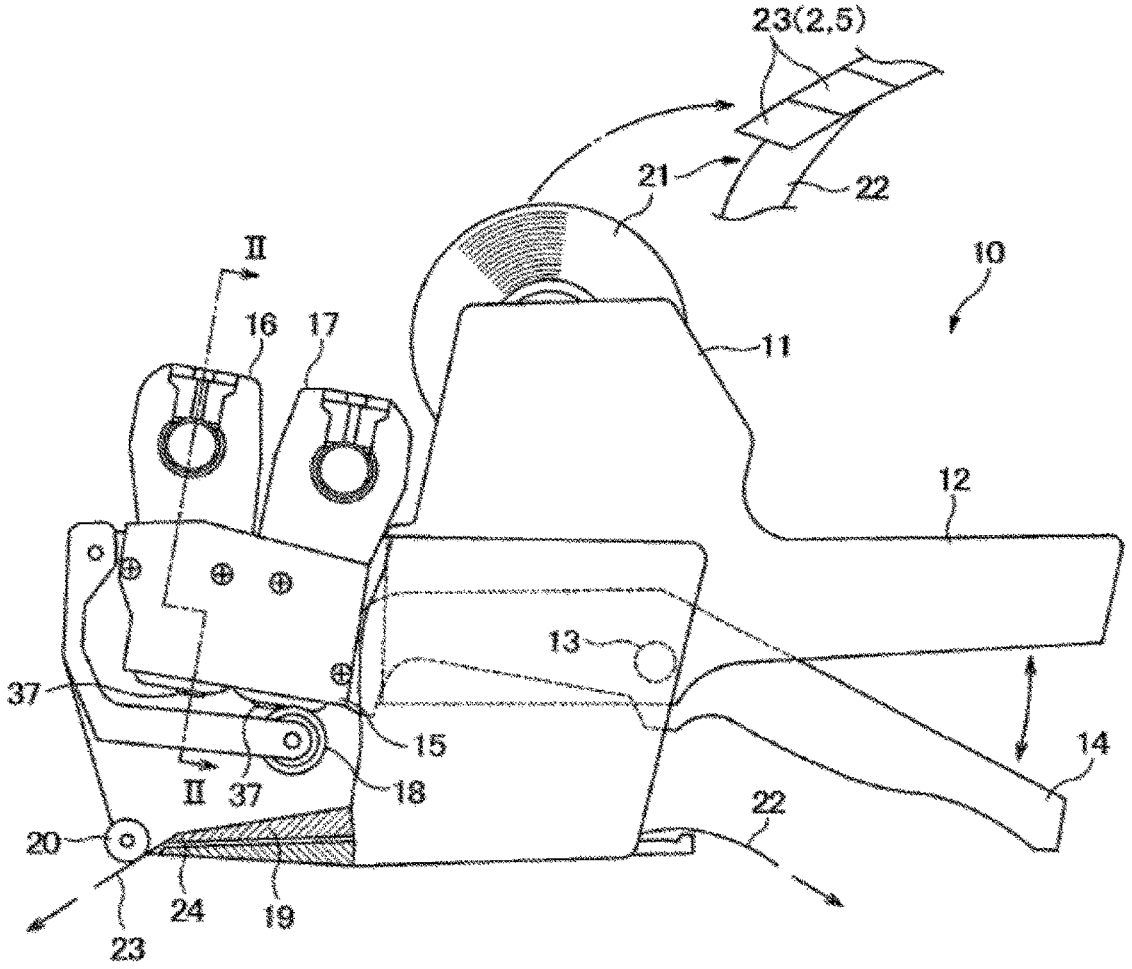
FIG. 1 is a partially cutaway side view illustrating a portable label printing/sticking machine 10 for describing a print method using a printer module of a portable label printing/sticking machine according to a first embodiment of the invention.

Next, a print method using a printer module of a portable label printing/sticking machine and a printer module according to a first embodiment of the invention will be described with reference to FIGS. 1 to 4C, in which like reference numerals denote like elements as in FIGS. 6A to 7B, and they will not be described repeatedly. FIG. 1 is a partially cutaway side view illustrating a portable label printing/sticking machine 10. The portable label printing/sticking machine 10 includes a sticking machine body 11, a grip 12 formed in the sticking machine body 11, a handling lever 14 provided pivotably against a lever shaft 13 provided in the sticking machine body 11, a vertical two-stage printer module (for example, including a first printer module 16 for an upper stage and a second printer module 17 for a lower stage) installed in a yoke 15 formed in a tip of the handling lever 14, an ink roller 18, a platen 19, and a sticking roller 20. A continuous label 21 having a roll shape is held in an upper part of the sticking machine body 11 and can be supplied to the inside in a ribbon shape.

In the continuous label 21, a plurality of label pieces 23 (corresponding to the label piece 1 of FIG. 6A and a label piece 5 of FIG. 7A) are temporarily adhered on a ribbon-shaped liner sheet 22. When a user grips the grip 12 and the handling lever 14 of the portable label printing/sticking machine 10, the first and second printer modules 16 and 17 are lowered toward the platen 19, and the ink is applied by the ink roller 18, so that the label piece 23 of the continuous label 21 is pressed onto the platen 19 for printing. By releasing the catch of the grip 12 and the handling lever 14, a carriage (not shown) in the sticking machine body 11 turns only the liner sheet 22 backward at a turning edge 24 of the platen 19, so that the label piece 23 is released from the liner sheet 22 and is then adhered onto a predetermined product or goods (not shown) using the sticking roller 20.

Figure 2:
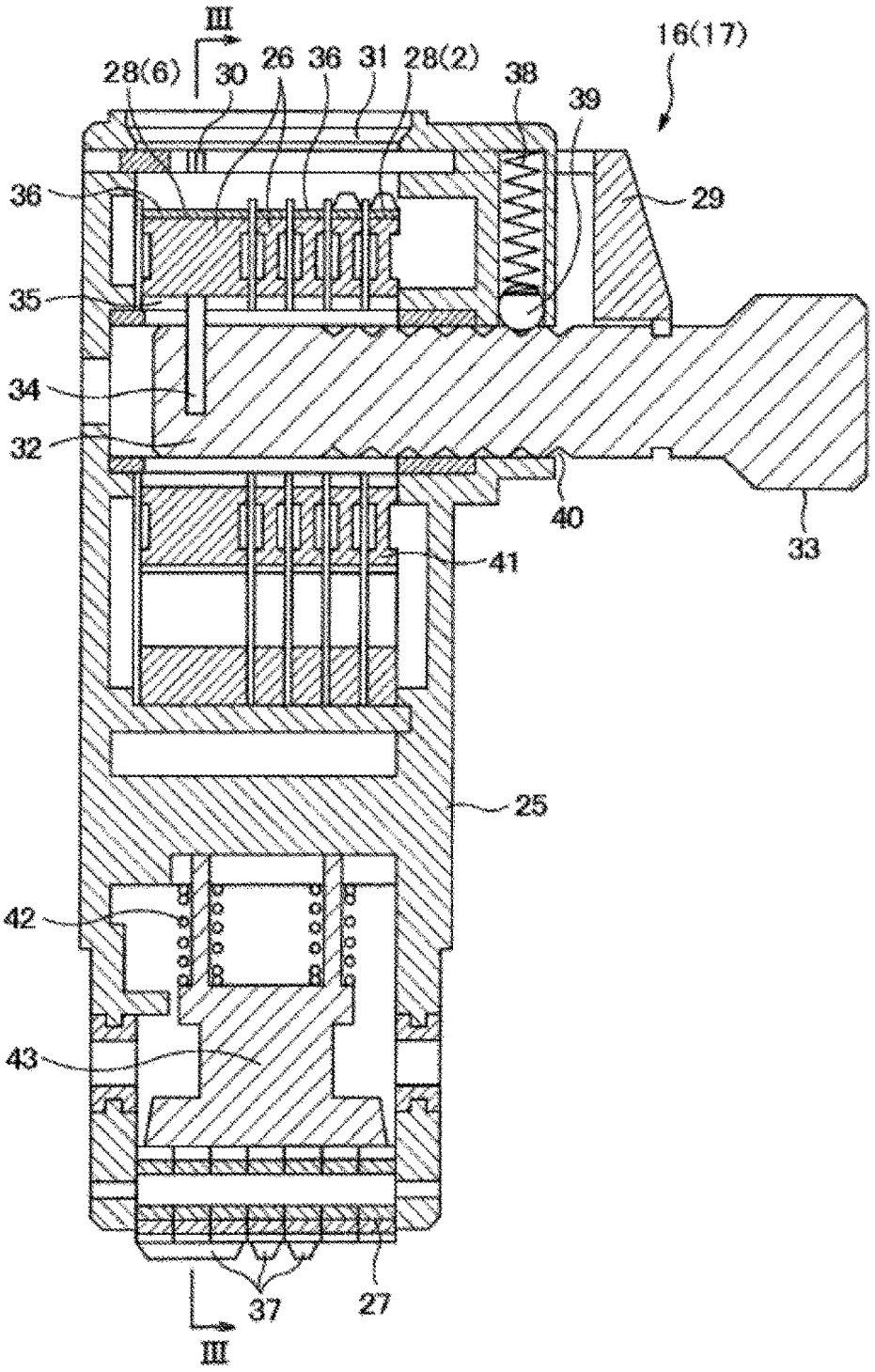
FIG. 2 is a cross-sectional view taken along a line II-II of FIG. 1 to illustrate a general configuration of a first printer module 16 (second printer module 17)
Figure 3:
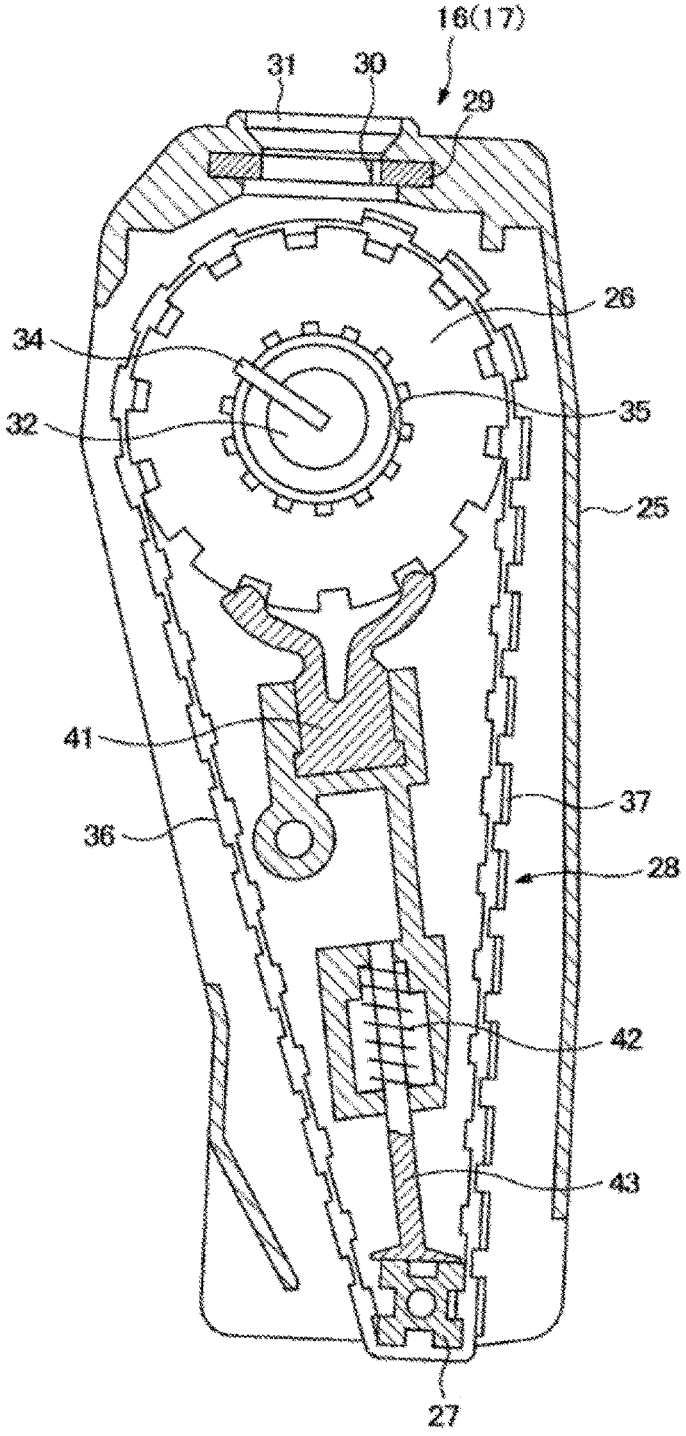
FIG. 3 is a cross-sectional view taken along a line III-III of FIG. 2.

FIG. 2 is a cross-sectional view taken along the line II-II of FIG. 1 to illustrate general configurations of the first and second printer modules 16 and 17. FIG. 3 is a cross-sectional view taken along the line of FIG. 2. Since the first and second printer modules 16 and 17 may have the same configuration, only the configuration of the first printer module 16 will be described below. The first printer module 16 includes a printer body 25 and an endless print band 28 extending between an index wheel 26 and a selection shaft member 27. Any letter or symbol of the print band 28 can be selected by manipulating a selection knob 33 of a selection shaft 32 while seeing an arrow tip 30 of an indicator 29 through an index window 31. That is, a selection pin 34 installed in the selection shaft 32 is engaged with inner circumferential concave portions 35 formed in the inner circumferential direction of each index wheel 26, so that each print letter and/or symbol 37 can be selected by rotating the print band 28 using the index wheel 26 while seeing index letters and/or symbols 36. Note that a steel ball 39 biased by a spring 38 is engaged with or disengaged from a selection groove 40 formed in the selection shaft 32, so that the print band 28 can be selected in a column direction by manipulating movement of the selection shaft 32.

In particular, as illustrated in FIG. 3, the index wheel 26 rotatably and stoppably supports the index letters and/or symbols 36 and the print letters and/or symbols 37 at their rotation angles by an elastic support body 41.

The selection shaft member 27 rotatably and stoppably supports these elements by a pressing member 43 biased by a spring 42.

Figure 7A:
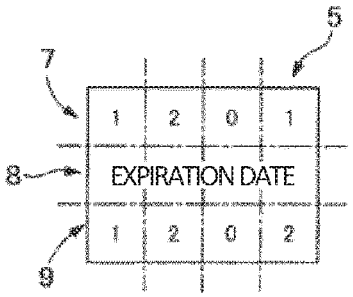
FIG.7A PRIOR ART
Figure 7B:
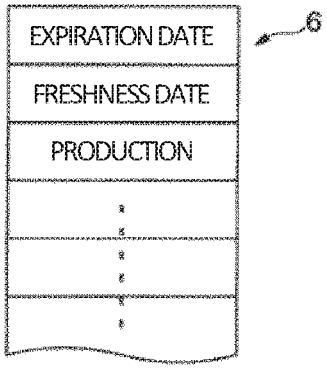
FIG.7B PRIOR ART

According to the present invention, the width and the number (number of columns) of the print band 28 in an axial direction of the selection shaft 32 and the print letters and/or symbols 37 for printing are appropriately changed depending on the types and the sizes of various item prints and data prints. That is, FIG. 2 illustrates an example thereof. In FIG. 2, the four right columns correspond to the print band 28 similar to a data print band 2 (FIG. 6B), and the left single column corresponds the print band 28 similar to the item print band 6 (FIG. 7B). Using the print band 28 as a representative of the data print band 2 and the item print band 6, it is possible to select a combination of the data print band 2 and the item print band 6 depending on the type and the size of various items and data to be printed on the label piece 23 of the continuous label 21.

Figure 4A:
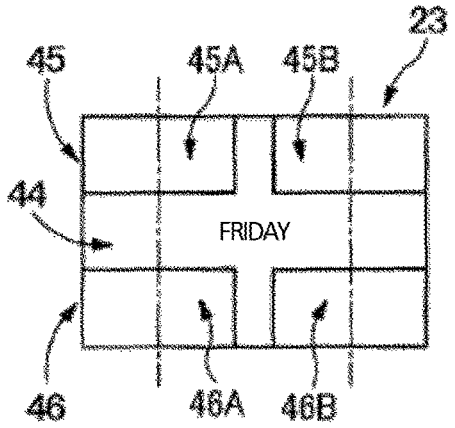
Figure 4B:
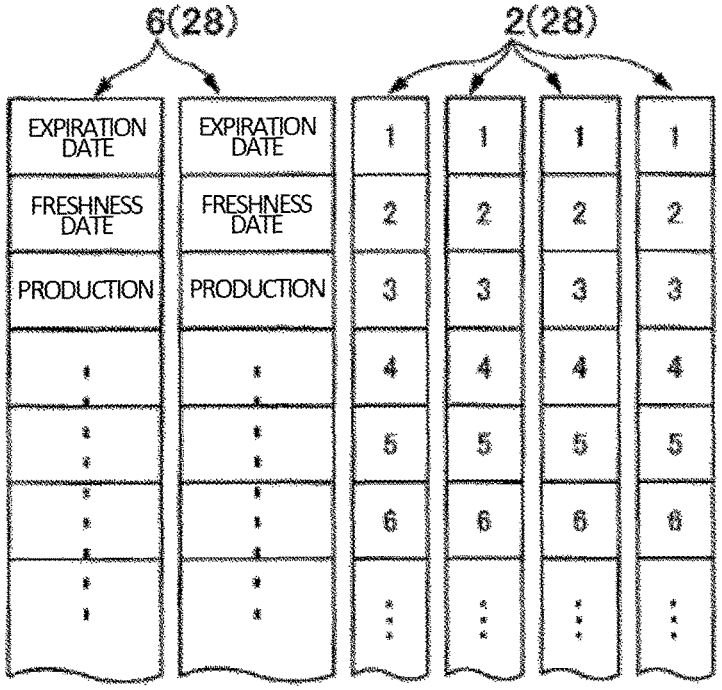
Figure 4C:
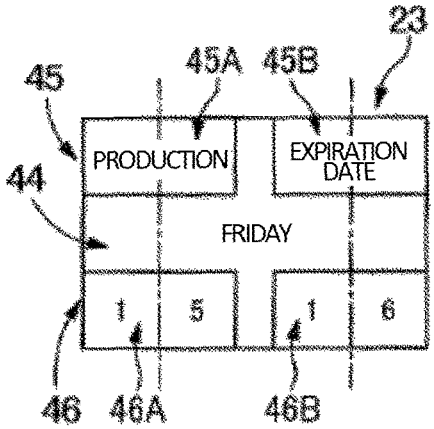

FIGS. 4A to 4C are diagrams for explaining a print method in two vertical stages on the label piece 23. FIG. 4A is a top plan view illustrating the label piece 23 before printing is performed in the two vertical stages. FIG. 4B is an exploded view illustrating the index letters and/or symbols arranged in two columns of the item print band 6 and four columns of the data print band 2 for printing. FIG. 4C is a top plan view illustrating the label piece 23 obtained by performing printing in two vertical stages.

As illustrated in FIG. 4B, an item print band 6 for at least two columns is provided in any one of the first and second printer modules 16 and 17 (for example, the first printer module 16) arranged in at least two vertical stages, and the data print band 2 is provided in the other printer module (for example, the second printer module 17).

As illustrated in FIG. 4A, a partitioning frame 44 (in FIG. 4A, drawn in a cross shape) for partitioning the print area of the label piece 23 into four regions, including upper left, upper right, lower left, and lower right regions, is printed in advance on the label piece 23. Then, printing is performed for the four regions of the print area using the first and second printer modules 16 and 17.

As illustrated in FIG. 4C, four regions are formed on the label piece 23, including the upper left, the upper right, the lower left, and the lower right regions. In any one of upper and lower print sections 45 and 46 (for example, the upper print section 45), an item (for example, "production" and "expiration date") is printed on two columns of left and right regions 45A and 45B using the item print band 6. In addition, in the other one of the upper and lower print sections 45 and 46 (for example, the lower print section 46) out of the four regions, data corresponding to the item (for example, the "15" corresponds to the "production," and "16" corresponds to the "expiration date") is printed on left and right regions 46A and 46B using the data print band 2.

Note that display data (for example, a fact that the corresponding product is sold in "Friday") relating to any one of the item print and the data print is printed in the partitioning frame 44 in advance as illustrated in FIGS. 4A and 4C. As a result, it is possible to increase the amount of displayed information. Furthermore, various colors may be painted, or an arbitrary design may be printed on the partitioning frame 44 in advance as the display data. This coloring or design makes it easy to distinguish the label piece 23 and increase the amount of displayed information.

As a result, the regions of the upper and lower print sections 45 and 46 (including the left region 45A, the right region 45B, the left region 46A, and the right region 46B) can be distinctively partitioned by the previously printed partitioning frame 44 on the label piece 23, and necessary items and data can be printed on each region. In addition, since the item print band 6 is provided in at least two columns, it is possible to increase the amount of information regarding the item print.

Figure 5A:
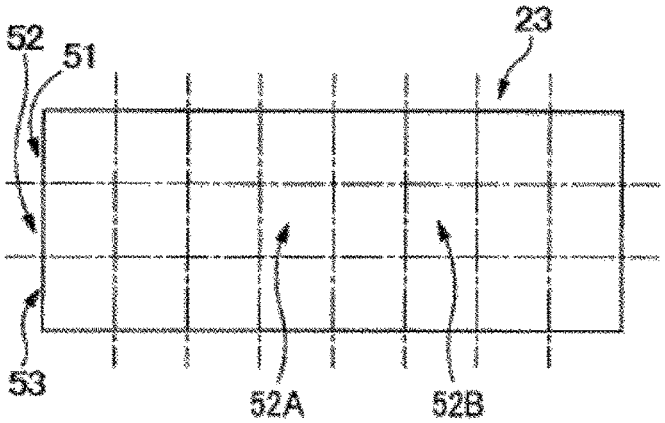
Figure 5B:
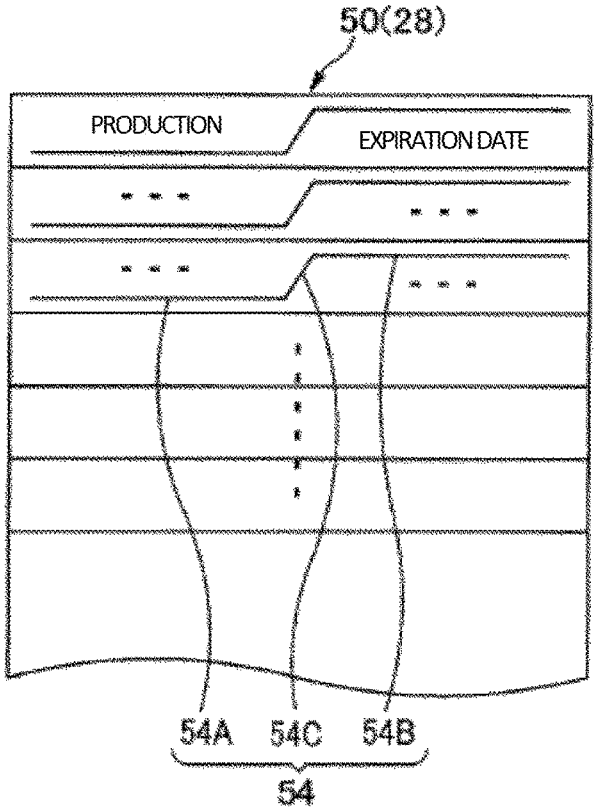
Figure 5C:
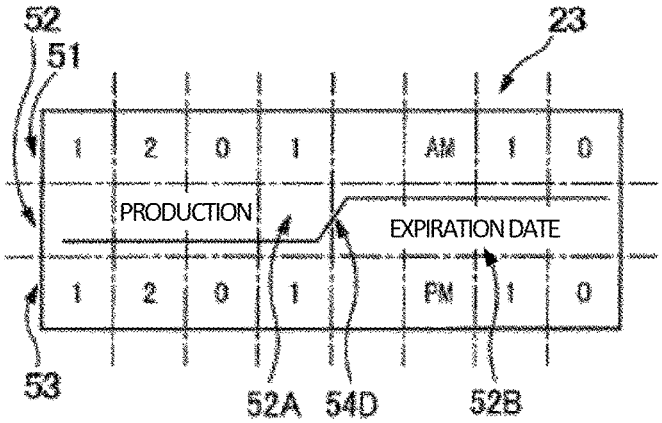
Figure 6A:
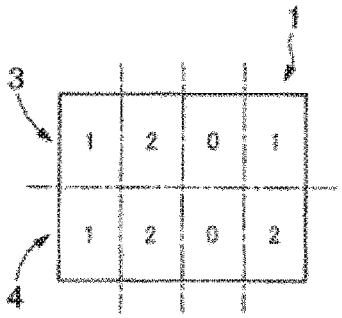
FIG.6A PRIOR ART
Figure 6B:
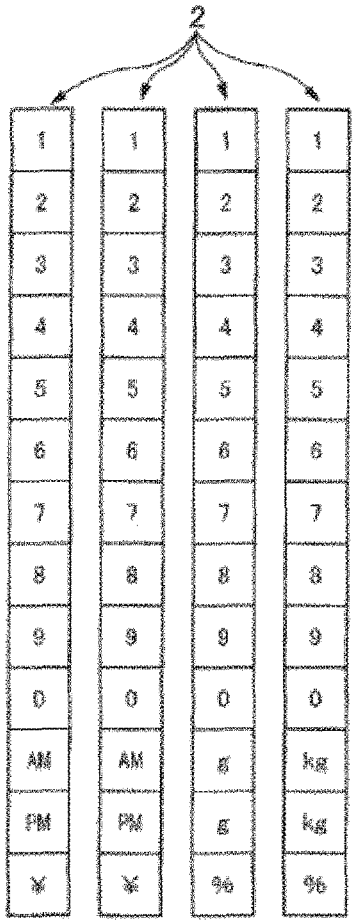
FIG.6B PRIOR ART

FIGS. 5A to 5C are diagrams for explaining a print method on three vertical stages of the label piece 23 according to a second embodiment of the invention. FIG. 5A is a top plan view illustrating the label piece 23 before printing is performed on three vertical stages. FIG. 5B is an exploded view illustrating the index letters and/or symbols of an item print band 50 for printing. FIG. 5C is a top plan view illustrating the label piece 23 obtained by performing printing on three vertical stages.

According to the second embodiment, a first printer module for printing on an upper print section 51, a second printer module for printing on a middle print section 52, and a third printer module for printing on a lower print section 53 are provided. The item print band 50 similar to those of the item print band 6 in the first printer module 16 (second printer module 17) described above and the data print band 2 are appropriately employed in the first to third printer modules.

That is, the item print band 50 for printing at least two types of items is provided in the second printer module located in the center, and the data print bands 2 are provided in the first and third printer modules located above and below the second printer module, so that data corresponding to the item can be printed.

Using the item print band 50, a partitioning frame 54 for partitioning the item print into two vertical regions (including the upper print section 51 and the lower print section 53) can be printed on the label piece 23 along with the items (for example, "production" and "expiration date").

Specifically, in particular, as illustrated in FIG. 5B, the partitioning frame 54 of the item print band 50 includes a lower line 54A that can be printed along with the item (for example, "production") in a left region 52A of the middle print section 52 and is located in the lower side of the left region 52A, an upper line 54B that can be printed along with the item (for example, "expiration date") in a right region 52B and is located in the upper side of the right region 52B, and a slash line 54C that connects the upper and lower lines 54A and 54B to each other.

As illustrated in FIG. 5C, the items such as "production" and "expiration date" and a partitioning frame print 54D are printed in the middle print section 52, and the data corresponding to the printed items, that is, "1201," "AM10," "1201," and "PM10" can be printed in the upper print section 51 and the lower print section 53 by appropriately selecting the item print band 50 capable of printing, for example, two types of items. Therefore, by appropriately selecting and combining the contents of the items to be printed from the item print band 50, it is possible to accurately perform necessary printing even when the amount of information for the item print increases.

REFERENCE SIGNS AND NUMERALS

1: label piece (prior art, FIG. 6A)
2: data print band
3: upper print section
4: lower print section
5: label piece (prior art, FIG. 7A)
6: item print band
7: upper print section
8: middle print section
9: lower print section
10: portable label printing/sticking machine (FIG. 1)
11: sticking machine body
12: grip
13: lever shaft
14: handling lever
15: yoke
16: first printer module (printer module)
17: second printer module (printer module)
18: ink roller
19: platen
20: sticking roller
21: continuous label
22: liner sheet
23: label piece (FIG. 4A and FIG. 5A)
24: turning edge
25: printer body
26: index wheel
27: selection shaft member
28: print band (print band 2, item print band 6, 50)
29: indicator
30: arrow tip
31: index window
32: selection shaft
33: selection knob
34: selection pin
35: inner circumferential concave portion
36: index letters and/or symbols
37: print letters and/or symbols
38: spring
39: steel ball
40: selection groove
41: elastic support body
42: spring
43: pressing member
44: partitioning frame (FIG. 4A)
45: upper print section
45A: left region of upper print section 45
45B: right region of upper print section 45
46: lower print section
46A: left region of lower print section 46
46B: right region of lower print section 46
50: item print band (FIG. 5B)
51: upper print section (FIG. 5A)
52: middle print section
52A: left region of middle print section 52
52B: right region of middle print section 52
53: lower print section
54: partitioning frame (FIG. 5B)
54A: lower line of partitioning frame 54
54B: upper line of partitioning frame 54
54C: slash line of partitioning frame 54
54D: partitioning frame print (FIG. 5C)

The invention claimed is:

1. A printer module of a portable label printing/sticking machine that performs printing on label pieces of a continuous label formed by temporarily adhering a plurality of label pieces on a ribbon-shaped liner sheet and sticking the label pieces, comprising a first printer unit, a second printer unit, and a third printer unit provided in three vertical stages, wherein the second printer unit is located between the first printer unit and the third printer unit and includes an item print band to print at least two types of items, data corresponding to the at least two types of items are printed using the first printer unit and the third printer unit located above and below the second printer unit, respectively, the item print band has a partitioning portion that partitions the item print band into two horizontal regions, and a partitioning frame print that partitions the at least two types of items into two horizontal regions is printed by the partitioning portion.

2. The printer module of the portable label printing/sticking machine according to claim 1, wherein the partitioning portion comprises at least one protrusion configured to print the partitioning frame print.

3. The printer module of the portable label printing/sticking machine according to claim 1, wherein the partitioning portion includes a first line, a second line parallel to the first line, and a diagonal line connecting the first line and the second line, and the first line, the second line, and the diagonal line are configured to print the partitioning frame print.

4. A printer module of a portable label printing/sticking machine that performs printing on label pieces of a continuous label formed by temporarily adhering a plurality of label pieces on a ribbon-shaped liner sheet and sticking the label pieces, comprising a first printer unit, a second printer unit, and a third printer unit provided in three vertical stages, wherein the second printer unit is located between the first printer unit and the third printer unit and is configured to print at least two types of items, the second printer unit comprises a band including a partitioning frame configured to print a partitioning frame print that partitions the at least two types of items into a plurality of regions separated by the partitioning frame print, and each of the first printer unit and the third printer unit is configured to print data corresponding to at least one of the two types of items.

5. The printer module of the portable label printing/sticking machine according to claim 4, wherein the first printer unit is configured to print data corresponding to at least one of the at least two types of items in a region above a portion of the partitioning frame print, and the third printer unit is configured to print data corresponding to at least one of the at least two types of items in a region below a portion of the partitioning frame print.

6. The printer module of the portable label printing/sticking machine according to claim 4, wherein the partitioning frame includes a first line, a second line parallel to the first line, and a diagonal line connecting the first line and the second line, and the first line, the second line, and the diagonal line are configured to print the partitioning frame print.

* * * * *